US010486860B2

(12) United States Patent
Frankenberg et al.

(10) Patent No.: US 10,486,860 B2
(45) Date of Patent: Nov. 26, 2019

(54) CONTAINER WITH DIVIDERS

(71) Applicant: Orbis Corporation, Oconomowoc, WI (US)

(72) Inventors: Jason R. Frankenberg, Lake Mills, WI (US); Paul Mans, Fort Atkinson, WI (US)

(73) Assignee: ORBIS Corporation, Oconomowoc, WI (US)

( * ) Notice: Subject to any disclaimer, the term of this patent is extended or adjusted under 35 U.S.C. 154(b) by 183 days.

(21) Appl. No.: 14/963,916

(22) Filed: Dec. 9, 2015

(65) Prior Publication Data

US 2016/0176577 A1 Jun. 23, 2016

Related U.S. Application Data

(60) Provisional application No. 62/094,226, filed on Dec. 19, 2014.

(51) Int. Cl.
*B65D 25/06* (2006.01)
*B65D 1/22* (2006.01)

(52) U.S. Cl.
CPC ..... *B65D 25/06* (2013.01); *B65D 1/22* (2013.01)

(58) Field of Classification Search
CPC . B65D 25/06; B65D 1/22; B65D 1/24; B65D 25/04
See application file for complete search history.

(56) References Cited

U.S. PATENT DOCUMENTS

| | | | | |
|---|---|---|---|---|
| 2,459,301 A | | 1/1949 | Adams | |
| 2,701,635 A | | 2/1955 | Mills | |
| 3,055,531 A | | 9/1962 | De Chelbor | |
| 3,129,838 A | * | 4/1964 | Wormer, III | B65D 1/243 220/510 |
| 3,305,076 A | * | 2/1967 | Fleenor | B25H 3/02 220/532 |
| 3,353,704 A | * | 11/1967 | Belcher | B65D 1/243 220/510 |
| 3,656,650 A | | 4/1972 | Frater | |

(Continued)

FOREIGN PATENT DOCUMENTS

| | | |
|---|---|---|
| CA | 2797383 A1 | 6/2013 |
| EP | 1435326 | 7/2004 |
| KR | 101425918 B1 | 8/2014 |

OTHER PUBLICATIONS

Russian Patent Office, International Search Report and Written Opinion of International Searching Authority for PCT/US2015/065060 dated Apr. 28, 2016 (7 pages).

(Continued)

*Primary Examiner* — James N Smalley
*Assistant Examiner* — Madison L Poos
(74) *Attorney, Agent, or Firm* — Greensfelder, Hemker & Gale, P.C.

(57) ABSTRACT

A container with dividers is provided. The container includes a container body having a bottom with ribs extending upward, a first side wall, a second side wall, a first end wall and a second end wall. An upper portion of the side walls and/or end walls include matching slots. A divider is provided having upper tabs for securing the divider in a set of slots, and rib slots in a bottom portion for securing the divider to the ribs in the bottom of the container body.

19 Claims, 6 Drawing Sheets

(56) References Cited

U.S. PATENT DOCUMENTS

| | | | | |
|---|---|---|---|---|
| 3,885,668 | A | 5/1975 | McClain | |
| 3,920,144 | A | 11/1975 | Callen | |
| 3,971,468 | A | 7/1976 | Helms et al. | |
| 4,436,215 | A | 3/1984 | Kleinert et al. | |
| 4,577,773 | A | 3/1986 | Bitel | |
| 5,427,446 | A | 6/1995 | Glomski | |
| 7,344,043 | B2 | 3/2008 | Nyeboer | |
| 7,344,044 | B2 | 3/2008 | Bradford et al. | |
| 7,410,094 | B2 | 8/2008 | Bos | |
| 7,428,975 | B2 | 9/2008 | Bradford | |
| 7,878,362 | B2 | 2/2011 | Nyeboer | |
| D639,560 | S | 6/2011 | Brown et al. | |
| 8,360,306 | B2 | 1/2013 | Vroon | |
| 8,950,113 | B1 * | 2/2015 | Schall | B65D 19/18 220/533 |
| 2006/0247112 | A1 | 11/2006 | Bradford | |
| 2008/0105687 | A1 | 5/2008 | Nyeboer | |
| 2008/0128428 | A1 | 6/2008 | Beckerman | |
| 2012/0223083 | A1 | 9/2012 | Hug | |
| 2013/0102450 | A1 | 4/2013 | Vroon | |
| 2013/0140313 | A1 | 6/2013 | Frankenberg et al. | |
| 2014/0124406 | A1 | 5/2014 | Ishikawa et al. | |

OTHER PUBLICATIONS

Photographs of prior known divider/container; publication date unknown (3 pages).

European Patent Office, Communication—Extended European Search Report from European Patent Application No. 15870747.1, dated Sep. 10, 2018, 6 pages.

* cited by examiner

CONTAINER WITH DIVIDERS

CROSS-REFERENCE TO RELATED APPLICATIONS

The present application claims the benefit of Provisional Application Ser. No. 62/094,226, filed Dec. 19, 2014, the contents of which are incorporated herein by reference.

FEDERALLY SPONSORED RESEARCH OR DEVELOPMENT

N/A

FIELD OF THE INVENTION

The present invention generally relates to a container having dividers configured to interlock with a rim portion of the container and a bottom portion of the container.

BACKGROUND OF THE INVENTION

A variety of containers are formed to accommodate adjustable dividers to provide compartments in the container and allow for adjusting the size of such compartments.

The present system provides an improved container with dividers.

SUMMARY OF THE INVENTION

The present invention provides a container or container system having a container body and one or more dividers, or a divider with one or more divider walls. The container includes an upper rim with slots for securing the divider(s). The container body includes a bottom having non-uniform structure (e.g., upwardly extending ribs). The divider is configured to accommodate such non-uniform structure (e.g., by having complimentary structure) to enable the divider to be secured to both the top of the container body and the bottom of the container body.

In accordance with one embodiment, a container with dividers is provided. The container comprises a container body having a bottom, a first side wall, an opposing second side wall, a first end wall and an opposing second end wall, an upper portion of the first side wall having a first tab slot and an upper portion of the second side wall having a first tab slot aligned with the first tab slot on the upper portion of the first side wall. The container includes a divider having a first upper tab configured to fit in a tab slot of the container body and a second upper tab configured to fit in a tab slot of the container body. The divider also includes a plurality of downwardly extending tabs from a bottom of the divider. The downwardly extending tabs are separated by one or more slots. The downwardly extending tabs of the divider can extend into recesses in the bottom to lock the divider in place.

In accordance with another embodiment, a container with dividers is provided. The container with dividers comprises a container body having a bottom, a first side wall, an opposing second side wall, a first end wall and an opposing second end wall. The container body can be substantially rectangular and formed from plastic. An upper portion of the first side wall has a first tab slot and an upper portion of the second side wall has a first tab slot aligned with the first tab slot on the upper portion of the first side wall. The bottom has a plurality of ribs extending upward. The container further comprises a divider having a first upper tab configured to fit in a tab slot of the container body and a second upper tab configured to fit in a tab slot of the container body. The first upper tab and the second upper tab of the divider are preferably T-shaped. The divider also includes rib slots in a lower portion configured to accommodate the ribs in the bottom of the container body.

In addition to the first tab slots, the upper portion of the first side wall can also include a second tab slot and a third tab slot where the first tab slot, second tab slot and third tab slot are spaced apart along the first side wall. Similarly, the upper portion of the second side wall can also include a second tab slot aligned with the second tab slot of the first side wall, and a third tab slot aligned with the third tab slot of the first side wall.

The ribs in the bottom can include a plurality of ribs extending linearly from the first side wall to the second side wall. The ribs in the bottom can also include a plurality of ribs extending linearly from the first end wall to the second end wall. In this configuration, the ribs extending linearly from the first side wall to the second side wall and the ribs extending linearly from the first end wall to the second end wall form rectangular recesses (such as square recesses) in the bottom.

The divider includes lower tabs formed between the rib slots. The lower tabs can be configured to fit in the rectangular recesses of the bottom.

The bottom can also include a central flat region without ribs. The central flat region can be at a height substantially equal to a height of the ribs in the bottom. In this instance, the divider would include a central straight portion positioned to accommodate the central flat region of the bottom.

The container body can also include a first tab slot in the first end wall, and a first tab slot in the second end wall aligned with the first tab slot in the first end wall. Similarly, the container body can include a second tab slot in the first end wall, and a second tab slot in the second end wall aligned with the second tab slot of the first end wall.

The divider can be positioned to extend from the first side wall to the second side wall (when the side walls are provided with one or more tab slots). Alternatively, the side wall can be positioned to extend from the first end wall to the second end wall (when the end walls are provided with one or more tab slots). When one or more tab slots are provided, the divider can be adjusted by moving it into another set of slots (or more compartments can be made by using more than one divider).

Alternatively, the divider can include a first divider wall sized to extend between the first side wall and the second side wall, and a second divider wall substantially perpendicular to the first divider wall sized to extend between the first end wall and the second end wall. In a further alternative, the divider can include more than one walls extending between the side walls, and/or more than one walls extending between the end walls.

The first upper tab can be positioned at a first side of the first divider wall and a second upper tab is positioned at a second side of the first divider wall. Additionally, the second divider wall can include a third upper tab configured to fit in a tab slot of the container body on a first side of the second divider wall and a fourth upper tab configured to fit in a tab slot of the container body on a second side of the second divider wall.

The first divider wall and the second divider wall can include at least one or more of the plurality of rib slots. Alternatively, the slots can all be on one of the divider walls.

In a further embodiment of the invention, a container and divider system is provided. The container and divider system comprise a container body having a generally rectangular bottom having a plurality of ribs extending upward. The container body also includes a first side wall, an opposing second side wall, a first end wall and an opposing second end wall, an upper rim portion formed in the first and second side walls and first and second end walls having a plurality of sets of aligned tab slots. The system also includes a divider having upper tabs for securing the divider to the rim portion of the container body and rib slots for securing the divider to the bottom of the container body.

Further aspects of the invention are disclosed in the Figures and are described herein.

BRIEF DESCRIPTION OF THE DRAWINGS

To understand the present invention, it will now be described by way of example, with reference to the accompanying drawings in which.

DETAILED DESCRIPTION

Figure 1:
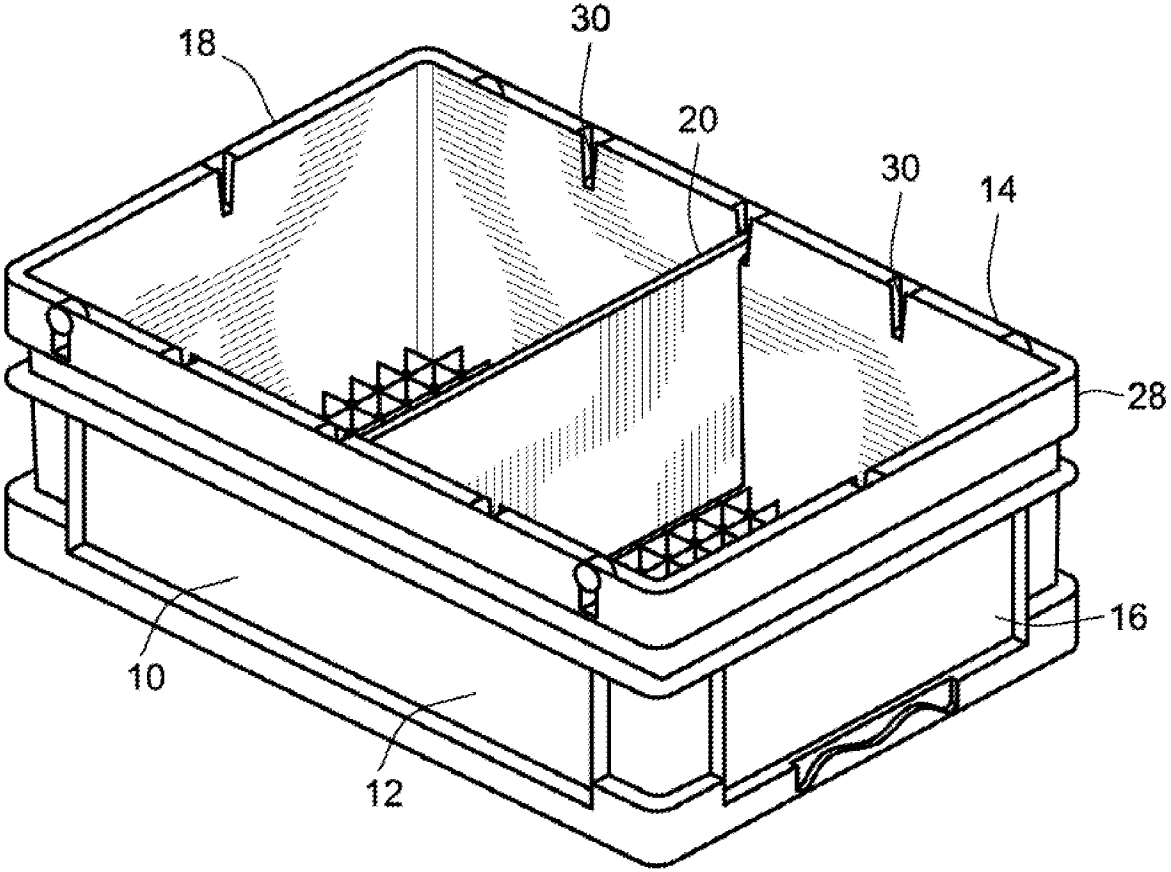
FIG. 1 is a perspective view of a container with a divider in accordance with an aspect of the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a container that includes a divider with one or more divider walls that connect to the upper rim of the container. The divider also includes protrusions to fit a non-uniform bottom, such as a bottom having ribs.

In accordance with one embodiment of the invention, FIG. 1 discloses a generally rectangular container body 10 having an open top. The container body 10 shown is typically referred to as a "tote." The container body 10 includes a first side 12, and opposing second side 14, a first end 16 and an opposing second end 18. A first divider 20 is shown extending from the first side 12 to the second side 14. The first divider 20 (in the embodiment shown) spans a width of the container body 10 (alternatively, the dividers can span a length of the container or both the width and length as discussed below and shown in FIG. 6).

Figure 2:
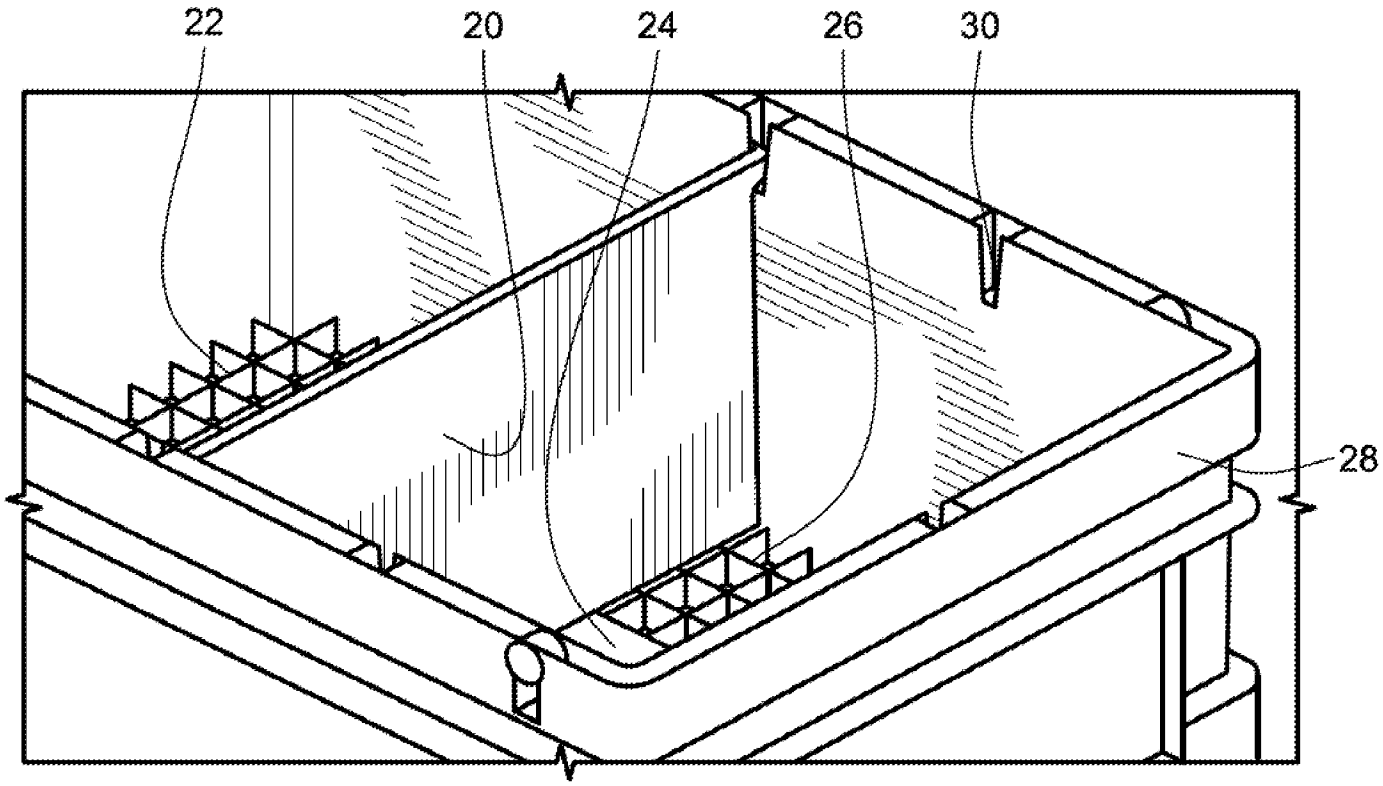
FIG. 2 is a perspective view of the container of FIG. 1 focusing on the divider.

As shown in FIG. 2, the container body 10 includes a rectangular bottom 22 having a centrally located flat portion 24. The remainder of the bottom 22 is a portion with a plurality of ribs 26 extending upward from a lower surface. Other than at the centrally located flat portion 24, the ribs 26 extend from the first side 12 to the second side 14, and from the first end 16 to the second end 18 to create generally squared off sections or recesses. The centrally located flat portion 24 of the bottom 22 includes an upper surface that is flush with the top edge of the ribs 26.

The container body 10 includes an upper rim portion 28 about each of the side walls 12, 14 and each of the end walls 16, 18. The upper rim portion 28 includes one or more sets of matching or corresponding slots 30 on each side wall 12, 14 (three sets of matching slots 30 are shown on the container body 10 of FIG. 1). Similarly, the upper rim portion 28 also includes one or more sets of matching slots 30 on each of the end walls 16, 18 (one set of matching slots 30 is shown on the container body 10 of FIG. 1). More or fewer sets of slots 30 can be provided as needed or desired.

Figure 5:
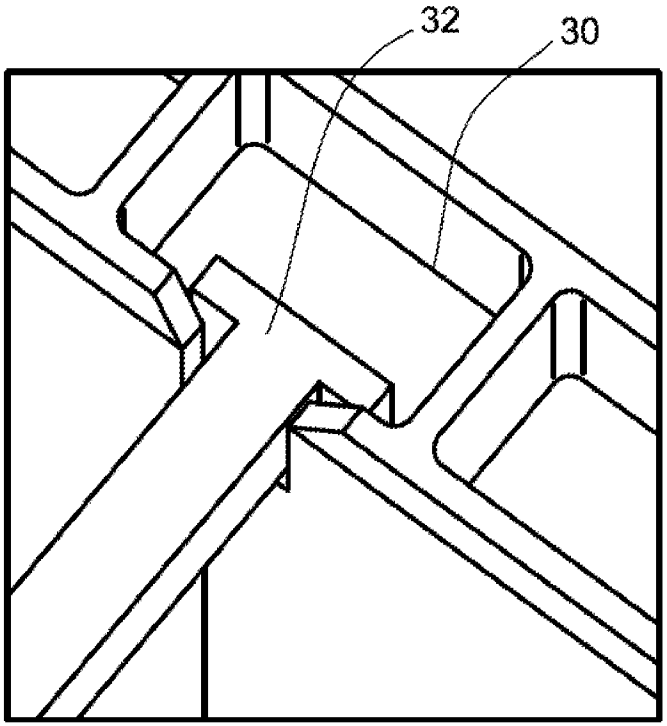
FIG. 5 is a perspective close-up view of the connection of the divider with the rim of the container of FIG. 1; and, FIG. 6 is a perspective view of a container with a divider in both the width and length direction in accordance with an alternative embodiment of the present invention.

The divider 20 shown in FIGS. 1 and 2 extends from the first side wall 12 to the second side wall 14. The divider 20 includes a first upper tab 32 on one side of the sheet 20, and a second upper tab on the other side of the sheet 20. As evident in FIG. 5, the tabs 32 have a T-shape configuration (when viewed from the top of the divider sheet 20). The T-shape corresponds to the shape of the slot 30.

Figure 3:
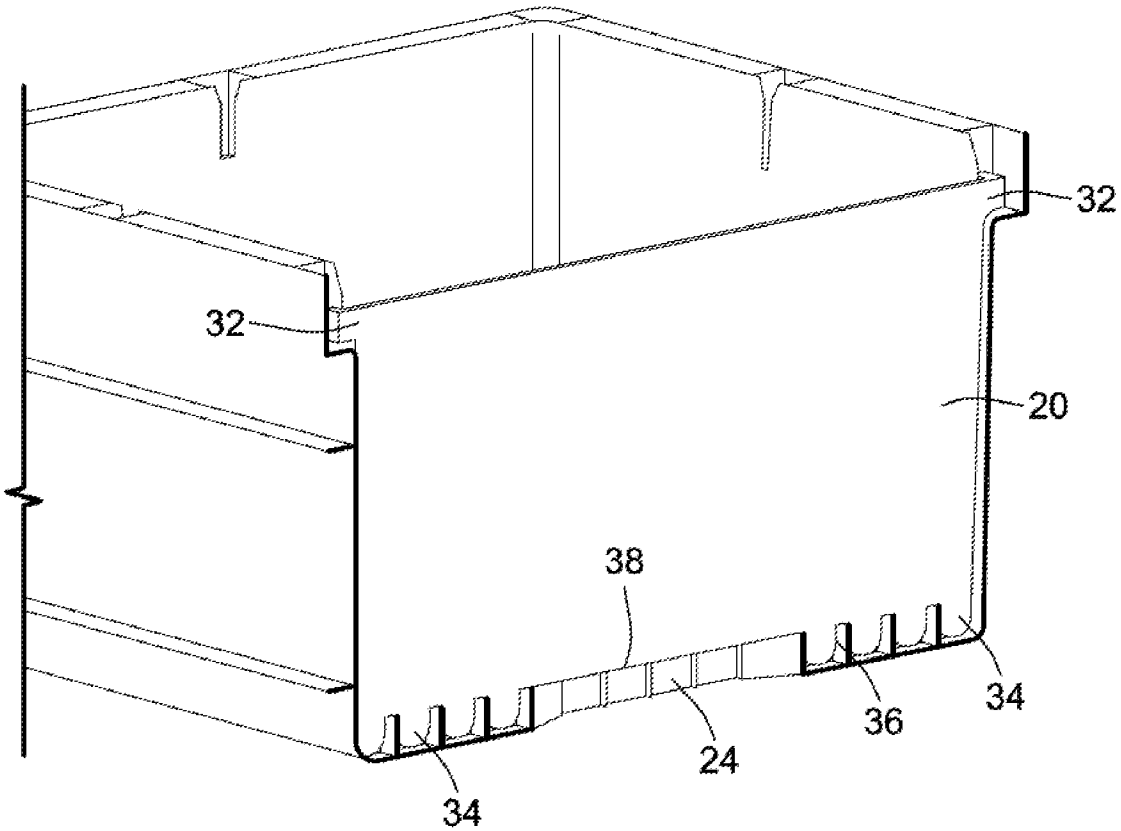
FIG. 3 is a perspective cross-sectional view of the container of FIG. 1 showing a forward face of the divider.
Figure 4:
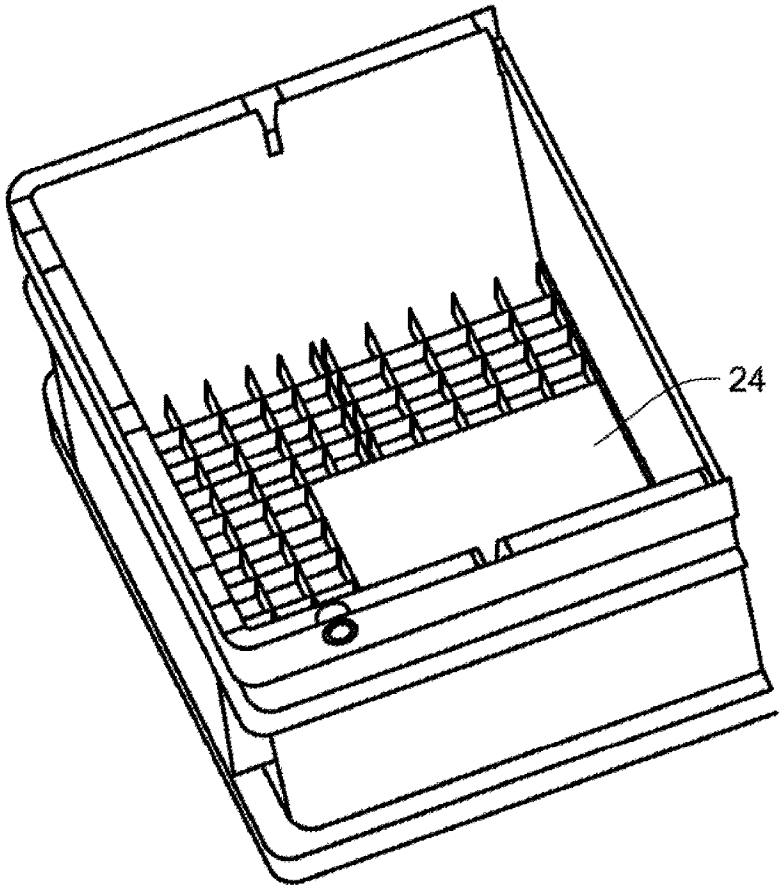
FIG. 4 is a perspective cross-sectional view of the container of FIG. 1 showing a back of the divider.

As shown in cross-section in FIG. 3, the divider 20 includes a plurality of tabs 34 separated by rib slots 36 extending downward at the bottom of the divider 20. The rib slots 36 are sized to accommodate the ribs 26 extending upward from the bottom 22. As shown in the Figure, the divider 20 includes a first set of tabs 34 proximate the first side wall 12 and a second set of tabs 34 proximate the second side wall 14. The divider 20 includes a central straight portion 38 between the two sets of tabs 34 and rib slots 36. The central straight portion 38 is at the height of the rib slots 36 (i.e., also the height of the ribs 26).

The tabs 34, slots 36 and central straight portion 38 of the divider 20 is designed to match the contour of the bottom 22 at the flat central portion 24. The tabs 34 fit into the square shapes defined by the ribs 26. This helps (along with the tabs 32) keep the divider 20 securely in place in the container body 10.

The same divider 20 can also be used in areas of the container body 20 having ribs extending from the first side wall 12 to the second side wall 14. In such areas the central straight portion 38 will rest on top of the ribs 26 and be above the square recesses. Alternatively, a divider 20 having tabs 34 extending across the entire bottom of the divider 20 can be used. The alternative divider would be limited to regions of the container having space to accommodate all of the tabs.

Figure 6:
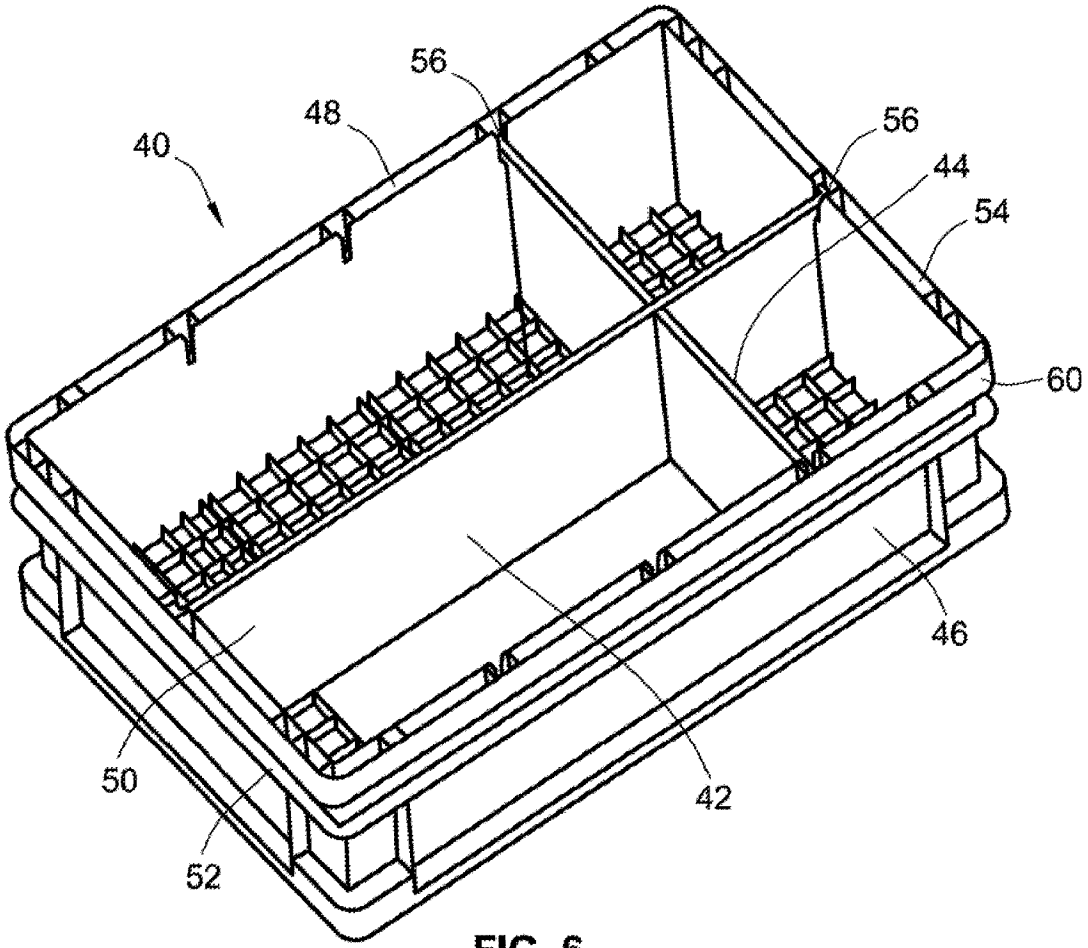

In an alternative embodiment illustrated in FIG. 6, a container body 40 (in this instance substantially similar or identical to the container body 10 of FIGS. 1-5) is shown with a T-shaped divider 42. The divider 42 includes a first divider wall 44 that spans between a first side wall 46 and an opposing second side wall 48, and a second divider wall 50 that spans between a first end 52 and an opposing second end 54. The divider 42 effectively creates four separate compartments in the interior of the container 40 (as opposed to two compartments created by the divider of FIGS. 1-5). The first and second divider walls 44, 50 are perpendicular to each other. While the divider 42 is shown having a single divider wall spanning the side walls and a single divider wall spanning the end walls, an alternative divider can be configured with two or more walls spanning the side walls, and/or two or more walls spanning the end walls.

The divider 42 is provided with tabs 56 at the ends of each divider wall 44, 50. The tabs 56 fit into slots 58 on one of the side walls 46, 48 or end walls 52, 54 of the container body 42 in the same manner as that shown with respect to the embodiment of FIGS. 1-5. The top of the side walls and end walls form a rim portion 60.

One or both of the divider walls 44, 50 of the divider 42 is provided with downwardly extending tabs (not shown)

separated by slots similar to the tabs 34 and slots 36 shown in the embodiment of the divider 20 of FIG. 3. The tabs fit into recesses or openings formed between ribs in the bottom of the container 40.

The combination of the rim structure and bottom structure (i.e., the ribs/slots/flat portion) help lock the divider 20 or 42 in place so that it does not fall out or slide out of place when product is loaded and transported in the container.

While the container body is shown having a bottom with a central flat portion 24 surrounded by square depressions formed by ribs 26, other bottom configurations (having different rib patterns or bottom structures) can be utilized with corresponding dividers having slots aligned with such ribs or otherwise have configurations to accommodate any other such bottom structures.

The side walls, end walls and bottom of the container body 10, 40 are preferably integrally connected. The container body can be plastic formed in a mold or other similar material. The divider can also be a molded plastic or other similar material.

Many modifications and variations of the present invention are possible in light of the above teachings. It is, therefore, to be understood within the scope of the appended claims the invention may be protected otherwise than as specifically described.

We claim:

1. A container with dividers comprising:

a container body having a bottom having an upper surface and a centrally located raised region, a first side wall, an opposing second side wall, a first end wall and an opposing second end wall, an upper portion of the first side wall having a first upper tab slot and an upper portion of the second side wall having a first upper tab slot aligned with the first tab slot on the upper portion of the first side wall, the bottom having a plurality of upwardly extending ribs defining a plurality of recesses with the upper surface of the bottom, wherein a portion of the upper surface of the bottom at the centrally located raised region is flush with a top edge of the upwardly extending ribs; and, a divider having a planar portion and a first upper tab configured to fit in an upper tab slot of the container body extending outward from a first side of the planar portion and a second upper tab configured to fit in an upper tab slot of the container body extending outward from a second side of the planar portion, the divider including a plurality of downwardly extending tabs having a flat portion that are co-planar with the planar portion extending downward from a bottom of the planar portion of the divider, the downwardly extending tabs of the divider separated by one or more slots in the divider between adjacent ones of the plurality of downwardly extending tabs, wherein the downwardly extending tabs of the divider extend into the recesses formed by the ribs in the bottom.

2. The container of claim 1 wherein the one or more slots in the divider are configured to accommodate the ribs in the bottom of the container body.

3. The container of claim 1 wherein the upper portion of the first side wall includes a second upper tab slot and a third upper tab slot, wherein the first upper tab slot, second upper tab slot and third upper tab slot are spaced apart along the first side wall.

4. The container of claim 3 wherein the upper portion of the second side wall includes a second upper tab slot aligned with the second upper tab slot of the first side wall, and a third upper tab slot aligned with the third upper tab slot of the first side wall.

5. The container of claim 1 wherein the first upper tab and the second upper tab of the divider are T-shaped.

6. The container of claim 3 wherein the ribs in the bottom include a plurality of ribs extending linearly from the first side wall to the second side wall and a plurality of ribs extending linearly from the first end wall to the second end wall, wherein the ribs extending linearly from the first side wall to the second side wall and the ribs extending linearly from the first end wall to the second end wall form the recesses and wherein each of the recesses has a rectangular shape.

7. The container of claim 6 wherein each of the one or more slots separating the downwardly extending tabs of the divider fit over one of the ribs extending linearly from the first side wall to the second side wall and the ribs extending linearly from the first end wall to the second end wall.

8. The container of claim 6 wherein the central region is flat.

9. The container of claim 8 wherein the central region is at a height substantially equal to a height of the ribs in the bottom.

10. The container of claim 9 wherein the divider includes a central straight portion positioned to accommodate the central region of the bottom.

11. The container of claim 1 wherein the first upper tab of the divider is positioned in the first tab slot of the first side wall, and the second upper tab of the divider is positioned in the first tab slot of the second side wall.

12. The container of claim 1 further comprising a first tab slot in the first end wall, and a first tab slot in the second end wall aligned with the first tab slot in the first end wall.

13. The container of claim 11 wherein the first upper tab of the divider is positioned in the first tab slot of the first end wall, and the second upper tab of the divider is positioned in the first tab slot of the second end wall.

14. The container of claim 12 further comprising a second tab slot in the first end wall, and a second tab slot in the second end wall aligned with the second tab slot of the first end wall.

15. The container of claim 12 wherein the divider includes a first divider wall sized to extend between the first side wall and the second side wall, and a second divider wall substantially perpendicular to the first divider wall sized to extend between the first end wall and the second end wall.

16. The container of claim 15 wherein the first upper tab is positioned at a first side of the first divider wall and a second upper tab is positioned at a second side of the first divider wall.

17. The container of claim 16 wherein the second divider wall includes a third upper tab configured to fit in a tab slot of the container body on a first side of the second divider wall and a fourth upper tab configured to fit in a tab slot of the container body on a second side of the second divider wall.

18. The container of claim 15 wherein both the first divider wall and the second divider wall include at least one of the slots between the plurality of downward extending tabs.

19. The container body of claim 15 comprising a third divider wall spaced from and parallel to the first divider wall.

* * * * *